US009416540B2

(12) United States Patent
Allen et al.

(10) Patent No.: US 9,416,540 B2
(45) Date of Patent: Aug. 16, 2016

(54) DUAL-ARCH ROOF TILE

(71) Applicant: Tapco International Corporation, Wixom, MI (US)

(72) Inventors: Clyde G. Allen, Columbiaville, MI (US); James A. Caldwell, Sachse, TX (US); Nathan D. Greenway, Attica, MI (US); Matt M. Jackson, Saline, MI (US); Michael W. Maurer, Walled Lake, MI (US); Matthew Jason Michalski, Sylvan Lake, MI (US); Dennis J. Paliaga, Orlando, FL (US); Jonathan Wierengo, Novi, MI (US)

(73) Assignee: Tapco International Corporation, Wixom, MI (US)

( * ) Notice: Subject to any disclaimer, the term of this patent is extended or adjusted under 35 U.S.C. 154(b) by 0 days.

(21) Appl. No.: 14/554,310

(22) Filed: Nov. 26, 2014

(65) Prior Publication Data

US 2015/0143767 A1 May 28, 2015

Related U.S. Application Data

(60) Provisional application No. 61/909,791, filed on Nov. 27, 2013.

(51) Int. Cl.

| | |
|---|---|
| ***E04D 1/00*** | (2006.01) |
| ***E04D 1/20*** | (2006.01) |
| *E04D 1/34* | (2006.01) |

(52) U.S. Cl.

CPC ..... *E04D 1/20* (2013.01); *E04D 2001/3423* (2013.01); *E04D 2001/3467* (2013.01)

(58) Field of Classification Search

CPC ..... E04D 1/20; E04D 1/00; E04D 1/12
USPC ..... 52/57, 71, 98, 309.1, 519
See application file for complete search history.

(56) References Cited

U.S. PATENT DOCUMENTS

| | | | | | |
|---|---|---|---|---|---|
| 2,131,043 | A | * | 9/1938 | Ochs et al. | 264/131 |
| 2,168,218 | A | * | 8/1939 | Kirschbraun | 52/560 |
| 3,086,899 | A | * | 4/1963 | Ingraham et al. | 428/158 |
| 4,128,369 | A | * | 12/1978 | Kemerer et al. | 425/113 |
| 4,290,248 | A | * | 9/1981 | Kemerer et al. | 52/309.16 |
| 4,514,947 | A | * | 5/1985 | Grail | 525/36 |
| 4,552,797 | A | * | 11/1985 | Munk et al. | 428/167 |
| 5,070,671 | A | * | 12/1991 | Fifield et al. | 52/533 |
| 5,094,058 | A | * | 3/1992 | Slocum | 52/533 |
| 5,615,523 | A | * | 4/1997 | Wells et al. | 52/98 |
| 5,630,305 | A | * | 5/1997 | Hlasnicek | 52/518 |

(Continued)

*Primary Examiner* — Basil Katcheves
*Assistant Examiner* — Joshua Ihezie
(74) *Attorney, Agent, or Firm* — Quinn Law Group, PLLC

(57) ABSTRACT

A tile for attachment to a mounting surface, with a fastener, includes a body defining a longitudinal length and a horizontal width. The body may be movable between an uninstalled position, which defines a first offset along the longitudinal length and a second offset along the transverse width, and an installed position, which substantially closes the first offset and the second offset. In the installed position, the body abuts the mounting surface and an underside of the body is substantially planar. The tile may also include a plurality of first-angle ribs and a plurality of second-angle ribs. The first-angle ribs are offset relative to a forward edge of the body. The second-angle ribs offset relative to the forward edge of the body and also to the first-angle ribs. Furthermore, the first-angle ribs and second-angle ribs do not have shared vertices.

6 Claims, 5 Drawing Sheets

(56) References Cited

U.S. PATENT DOCUMENTS

| | | | | |
|---|---|---|---|---|
| 5,635,125 | A * | 6/1997 | Ternes et al. | 264/328.18 |
| 5,711,126 | A * | 1/1998 | Wells | 52/519 |
| 5,855,277 | A * | 1/1999 | Apps et al. | 206/510 |
| D405,269 | S * | 2/1999 | Schulz | D5/37 |
| 5,946,877 | A * | 9/1999 | Gallinat et al. | 52/543 |
| 6,021,611 | A * | 2/2000 | Wells et al. | 52/98 |
| 6,112,492 | A * | 9/2000 | Wells et al. | 52/558 |
| 6,161,353 | A * | 12/2000 | Negola et al. | 52/453 |
| 6,164,034 | A * | 12/2000 | Roetheli et al. | 52/560 |
| 6,368,454 | B1 * | 4/2002 | Dwiggins et al. | 162/117 |
| 6,418,692 | B1 * | 7/2002 | Freshwater et al. | 52/553 |
| 6,877,288 | B2 * | 4/2005 | Shirota | 52/416 |
| 7,351,462 | B2 * | 4/2008 | Friedman et al. | 428/68 |
| 7,585,556 | B2 * | 9/2009 | Julton | 428/156 |
| 7,820,010 | B2 * | 10/2010 | Lostocco et al. | 162/168.1 |
| 8,136,322 | B2 * | 3/2012 | Shadwell et al. | 52/518 |
| 8,567,601 | B2 * | 10/2013 | Turek et al. | 206/323 |
| 8,572,921 | B2 * | 11/2013 | Ward et al. | 52/519 |
| 2001/0002527 | A1 * | 6/2001 | Malloy | 52/404.3 |
| 2002/0104288 | A1 * | 8/2002 | O'Sullivan et al. | 52/782.1 |
| 2005/0076562 | A1 * | 4/2005 | Huang | 47/44 |
| 2005/0153103 | A1 * | 7/2005 | Meyer et al. | 428/156 |
| 2005/0193669 | A1 * | 9/2005 | Jenkins et al. | 52/392 |
| 2005/0226779 | A1 * | 10/2005 | Oldham et al. | 422/99 |
| 2006/0026908 | A1 * | 2/2006 | Gregori et al. | 52/105 |
| 2006/0079173 | A1 * | 4/2006 | Coulton et al. | 454/365 |
| 2008/0135195 | A1 * | 6/2008 | Hermans et al. | 162/135 |
| 2009/0255037 | A1 * | 10/2009 | Sandusky et al. | 2/455 |
| 2010/0037548 | A1 * | 2/2010 | Kalkanoglu et al. | 52/309.1 |
| 2010/0252956 | A1 * | 10/2010 | MacKinnon et al. | 264/299 |
| 2011/0061323 | A1 * | 3/2011 | Schwarz et al. | 52/314 |
| 2011/0104434 | A1 * | 5/2011 | Masanek et al. | 428/137 |
| 2011/0138710 | A1 * | 6/2011 | Reisdorf et al. | 52/173.3 |
| 2011/0185665 | A1 * | 8/2011 | Allen et al. | 52/311.1 |
| 2012/0117908 | A1 * | 5/2012 | Turek et al. | 52/519 |
| 2013/0071625 | A1 * | 3/2013 | Masanek et al. | 428/172 |
| 2013/0160824 | A1 * | 6/2013 | Khouri et al. | 136/251 |

* cited by examiner

DUAL-ARCH ROOF TILE

CROSS-REFERENCE TO RELATED APPLICATIONS

This application claims the benefit of U.S. Provisional Application No. 61/909,791, filed Nov. 27, 2013, which is hereby incorporated by reference in its entirety.

TECHNICAL FIELD

This disclosure relates to roofing or siding tile systems for attachment to mounting surfaces.

BACKGROUND

Natural slate tiles may be used as roofing shingles or siding tiles. These tiles are often hand-split from larger sheets or blocks of slate and may require specialized tools and expert craftspeople. Slate shingles provide enhanced aesthetics as a roofing material. Other natural stone or manufactured stone materials may be used to create similar roofing tiles.

SUMMARY

An injection-molded tile for attachment to a mounting surface is provided. The tile is generally attached via at least one fastener. The tile includes a body having a face side opposite the mounting surface and an underside adjacent to the mounting surface.

A plurality of first-angle ribs and a plurality of second-angle ribs are formed on the underside of the body. The first-angle ribs are disposed at a first offset angle relative to a forward edge of the body, and the second-angle ribs are disposed at a second offset angle relative to the forward edge of the body. The first-angle ribs and second-angle ribs do not have shared vertices and the second offset angle is different from the first offset angle.

The injection-molded tile may be movable between an uninstalled position and an installed position. In the uninstalled position, the body defines a first offset along a longitudinal length between the body and the mounting surface. In the installed position, the body is biased against the mounting surface by the fastener to substantially close the first offset, such that the underside of the body abuts the mounting surface.

The above features and advantages, and other features and advantages, of the present subject matter are readily apparent from the following detailed description of some of the best modes and other embodiments for carrying out the disclosed structures, methods, or both

DETAILED DESCRIPTION

Figure 1:
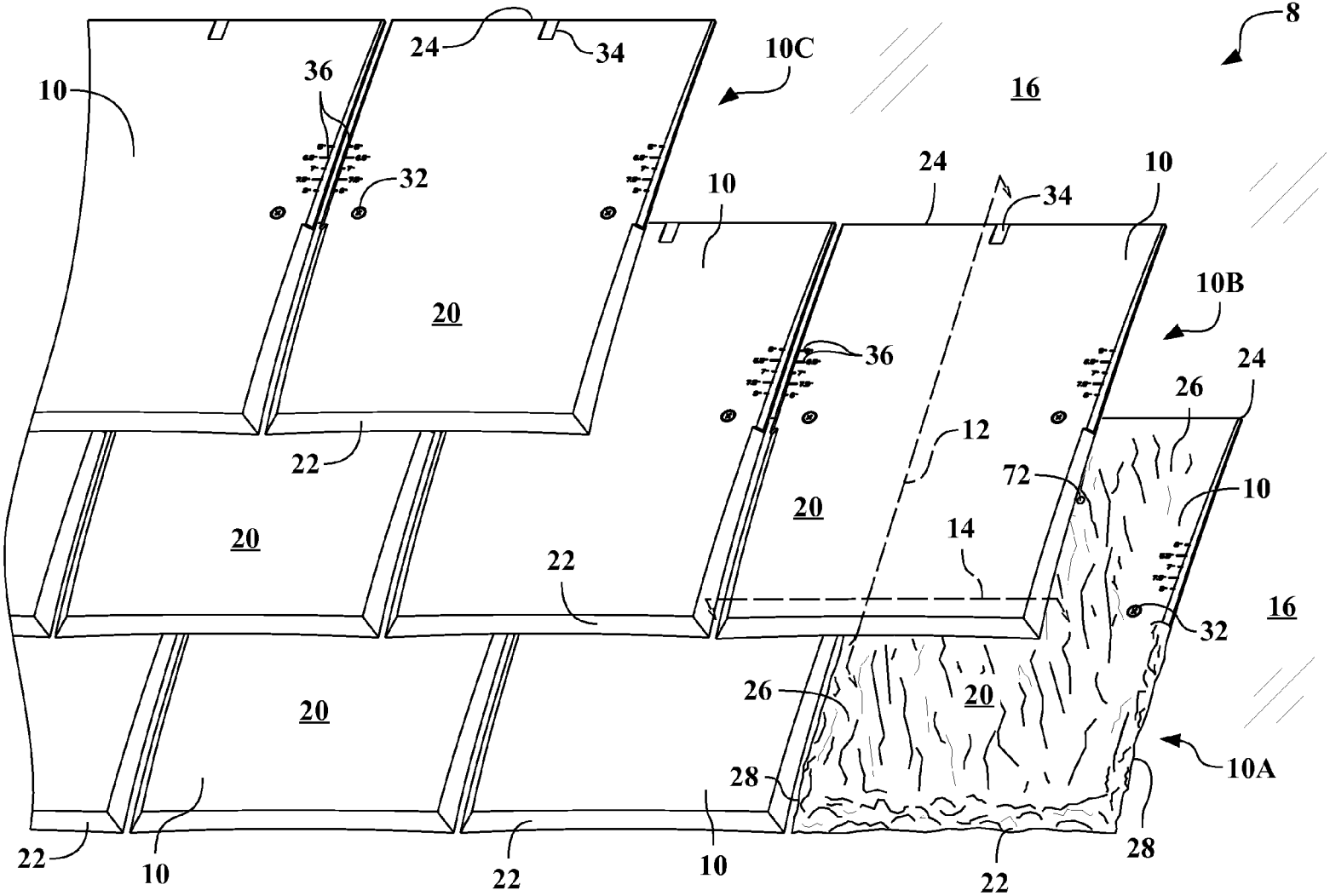
FIG. 1 is a schematic isometric view of roof tiles usable to create a roofing system on a mounting surface.

Referring to the drawings, like reference numbers correspond to like or similar components wherever possible throughout the several figures. There is shown in FIG. 1 a roofing system 8 formed from at least one roof tile 10. In FIG. 1, a plurality of the roof tiles 10 are arranged in a first course 10A, a second course 10B, and a third course 10C to create the portion of the roofing system 8 shown. The roof tile 10 is schematically illustrated with a y-axis 12 and an x-axis 14. In most installations, the y-axis 12 will be oriented with the slope of a mounting surface 16 and the x-axis 14 will be substantially perpendicular to the slope of the mounting surface 16, such that the x-axis 14 is at a single elevation.

The mounting surface 16 may be a sloped or angled roof. The roof tile 10 may be attached to the mounting surface 16 with at least one fastener 18 (not shown in FIG. 1, viewable in FIG. 4B), which may be, for example and without limitation, a nail, a screw, or a staple.

Note that the roof tile 10 shown may also be used as siding along a vertical, or substantially-vertical, wall. The principles of operation and benefits described herein apply to both roof and siding applications.

While the present invention may be described with respect to specific applications or industries, those skilled in the art will recognize the broader applicability of the invention. Those having ordinary skill in the art will recognize that terms such as "above," "below," "upward," "downward," et cetera, are used descriptively of the figures, and do not represent limitations on the scope of the invention, as defined by the appended claims. Any numerical designations, such as "first" or "second" are illustrative only and are not intended to limit the scope of the invention in any way.

Features shown in one figure may be combined with, substituted for, or modified by, features shown in any of the figures. Unless stated otherwise, no features, elements, or limitations are mutually exclusive of any other features, elements, or limitations. Furthermore, no features, elements, or limitations are absolutely required for operation. Any specific configurations shown in the figures are illustrative only and the specific configurations shown are not limiting of the claims or the description.

The roof tile 10 is formed from a body 20, which is a substantially-continuous component and may be formed from different types of plastic or composite materials. The body defines a vertical or longitudinal length along the y-axis 12 and a horizontal or transverse width along the x-axis 14. The y-axis 12 is generally oriented along the portion of the mounting surface 16 having vertical or elevational change. The span of the y-axis 12 may also be referred to as the longitudinal arch and the x-axis 14 may also be referred to as the transverse arch.

Figure 2:
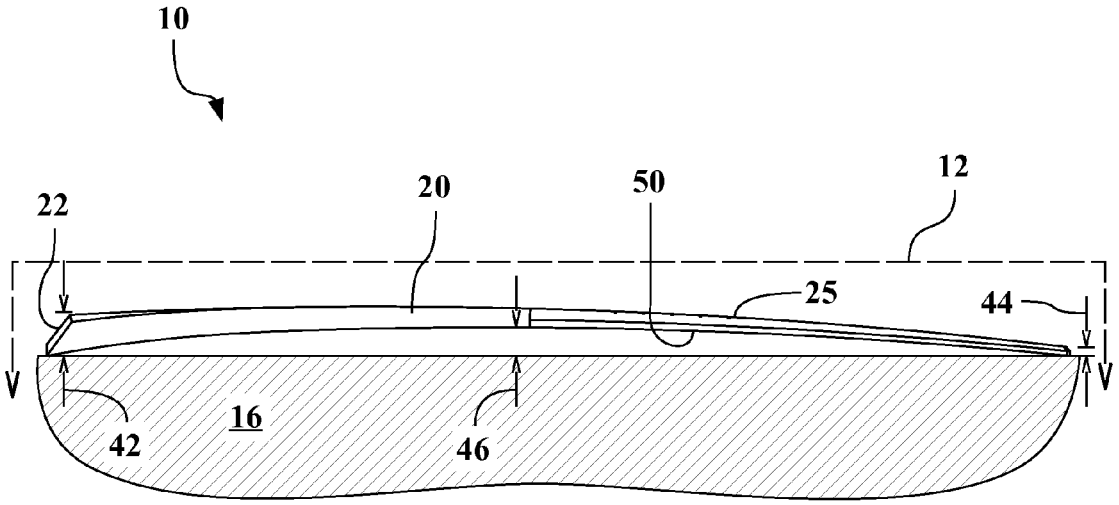
FIG. 2 is a schematic side view showing a longitudinal span of one of the roof tiles shown in FIG. 1.
Figure 3:
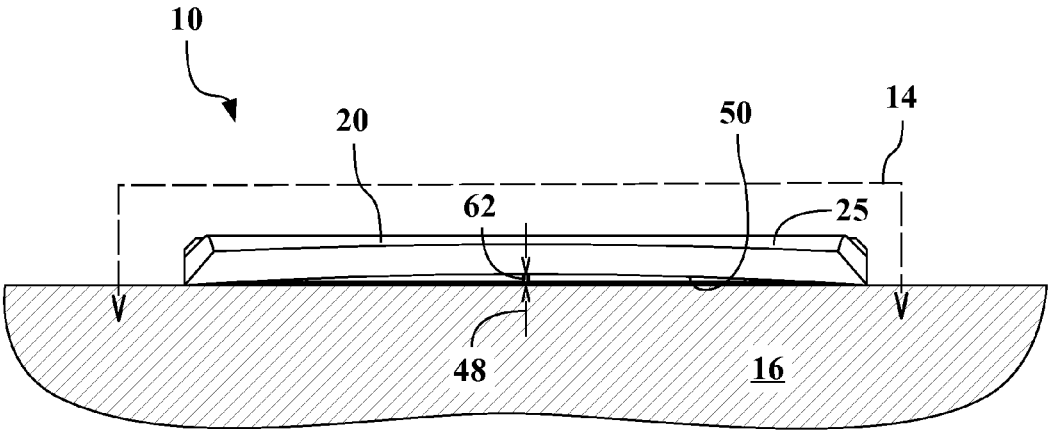
FIG. 3 is a schematic front view showing a transverse span of one of the roof tiles shown in FIG. 1.
Figure 4A:
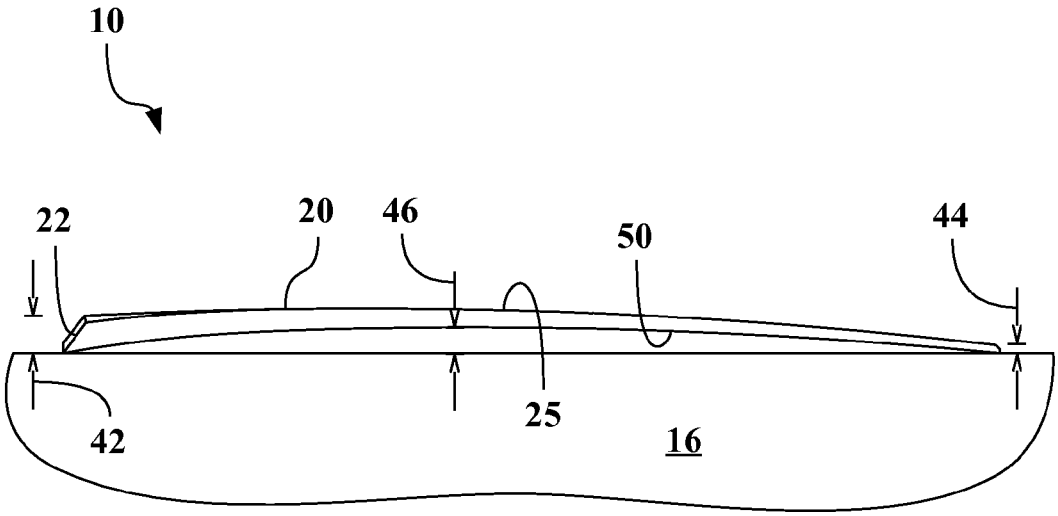
FIG. 4A is a schematic side view of the roof tile outline in an uninstalled position.
Figure 4B:
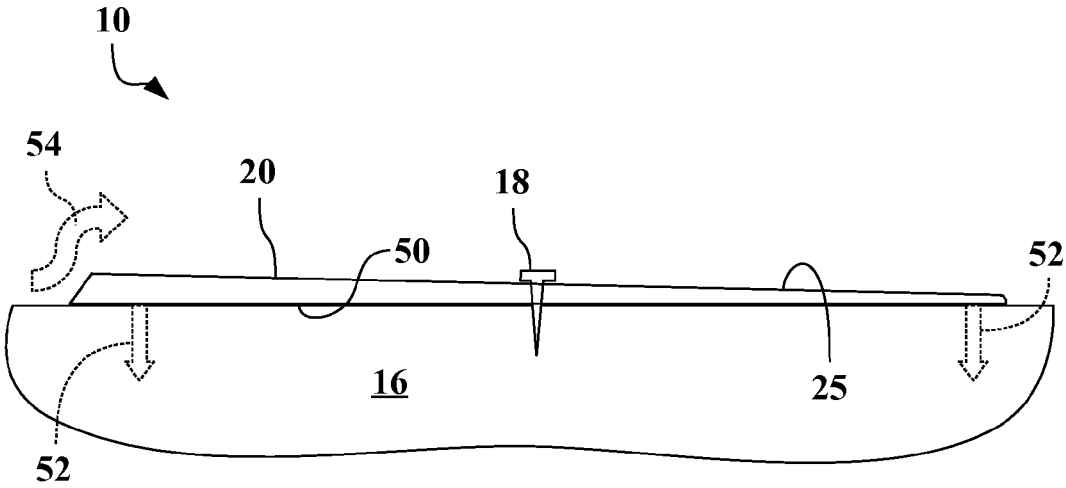
FIG. 4B is a schematic side view of the roof tile outline in an installed position, in which a fastener biases the roof tile against the mounting surface.

As will be described herein, the body 20 is movable between an uninstalled position (as illustrated in FIGS. 2, 3, and 4A) and an installed position (as illustrated in FIG. 4B). Generally, in the uninstalled position, the roof tile 10 has both transverse and longitudinal concavity-creating gaps or offsets from the mounting surface 16. The body 20 is capable of elastic deformation between the uninstalled position and the installed position.

A forward edge 22 of the body 20 is on the downward side or lower portion of the roof tile 10, relative to the mounting surface 16. A rearward edge 24 is the upward side or higher portion of the roof tile 10, relative to the mounting surface 16. The rearward edge 24 may be chamfered toward the mounting surface 16.

The roof tile 10 shown generally emulates slate or stone roofing tiles, even though it is formed from polymeric materials. However, the roof tile 10 may emulate other materials, such as wood shingles or clay tiles, without changing the functional and aesthetic benefits described and shown herein.

As shown in FIG. 1, the body 20 has a face side 25—opposite the mounting surface 16—with a textured surface 26 spreading from the forward edge 22 toward the rearward edge 24, such that the roof tile 10 emulates the texture and grain found on natural slate. One or more non-linear edges 28, such as the sides, further provide texture and improve the aesthetics of the roof tile 10. The forward edge 22 may also be non-linear, which may further assist in emulating the look and feel of natural slate tiles.

Note that only one of the roof tiles 10 shown in FIG. 1 is illustrated with the textured surface 26 and the non-linear edges 28, while the remainder of the roof tiles 10 are shown with substantially smooth surfaces and linear or arced edges. The textured surface 26 and the non-linear edges 28 may not be illustrated in other figures. In many configurations of the roofing system, the roofing tiles 10 will have numerous different textures or patterns of the textured surface 26. Therefore, several, if not all, of the roof tiles 10 will have different aesthetic looks.

One or more fastener points 32 are marked on the roof tile 10, such as through indentations, molded features, or ink. The fastener points 32 help an installer identify locations through which the one or more fasteners 18 should be driven into the mounting surface 16.

The body 20 further includes or defines a center mark 34 at the rearward edge 24. The body 20 may also include or define one or more length marks 36, which may be used in conjunction with chalk lines on the mounting surface 16 to vertically locate the roof tile 10 relative to other roof tiles 10.

One typical installation method involves laying a first course 10A of roof tiles 10 horizontally along the lower edge of the mounting surface 16, such that the forward edge 22 is substantially parallel with the lower edge of the mounting surface 16. Additional roof tiles 10 are arranged within the first course 10A as illustrated in FIG. 1. Then, a second course 10B of the roof tiles 10 are aligned above the first course 10A, such that the forward edge 22 of the roof tiles 10 in the second course 10B covers the fastener points 32 of the roof tiles 10 within the first course 10A. Additional courses, such as a third course 10C, may then be assembled to the mounting surface 16 above the previous course.

Generally, the subsequent course is horizontally offset by approximately one-half the width of the roof tiles 10. Note that the non-textured portion effectively becomes part of the mounting surface 16 for the subsequent roof tiles 10. In some installations, an underlayment layer may be placed between the mounting surface 16 and the roof tiles 10.

As used herein, the term substantially refers to quantities, values, or dimensions that are within manufacturing variance or tolerance ranges of being exact or that are subject to human error during installation. Substantially equal dimensions, for example, may be planned as ideally equal but normal manufacturing tolerances may cause the resulting dimensions to vary by 10-20% for different pieces.

During installation of the roof tile 10, the installer places the roof tile 10 onto the mounting surface 16. At this point, the roof tile 10 is in the uninstalled position and both the longitudinal arch and the transverse arch are visible as camber away from the mounting surface 16. The installer then flexes the body 20 against the mounting surface 16 to remove the camber and drives the fastener 18 through the body into the mounting surface 16. Alternatively, the installer may simply drive the fastener 18 through the body 20 until the head of the fastener 18 is flush with the body 20 and the body 20 is flush with the mounting surface 16.

Referring now to FIG. 2 and to FIG. 3, and with continued reference to FIG. 1, there are shown two additional, schematic, views of the roof tile 10. FIG. 2 shows the roof tile 10 from the side to illustrate the y-axis 12 or the longitudinal span. FIG. 2 shows the roof tile 10 from the front to illustrate the x-axis 14 or the transverse span. Both FIG. 2 and FIG. 3 show the roof tile 10 in its uninstalled position, such that the dual arches of the roof tile 10 are viewable.

As shown in FIG. 2, the body 20 has a forward thickness 42 at the forward edge 22 and a rearward thickness 44 at the rearward edge 24. In the configuration illustrated in figures, the forward thickness 42 is greater than the rearward thickness 44, such that the roof tile 10 is sloped or wedge-shaped. However, the forward thickness 42 and the rearward thickness 44 may be substantially equal or may have varying degrees of front-to-back drop.

In the uninstalled position, the body 20 has or defines a first offset 46 along the longitudinal length or vertical span of the roof tile 10. The first offset 46 creates a gap or space between the body 20 and the mounting surface 16, as shown in FIG. 2.

In the uninstalled position, the body 20 has or defines a second offset 48 along the transverse width or horizontal span of the roof tile 10. The second offset 48 creates a gap or space between the body 20 and the mounting surface 16, as shown in FIG. 3. Therefore, portions of an underside 50 of the roof tile 10 are not in contact with the mounting surface 16 while the roof tile 10 is in the uninstalled position. The underside 50 is the opposing side of the body 20 from the face side 25, which includes all of the portions generally viewable in FIG. 1.

Referring now to FIG. 4A and to FIG. 4B, and with continued reference to FIGS. 1-3, there are schematic outline views of the roof tile 10 to illustrate both the uninstalled and the installed positions. FIG. 4A schematically shows an outline of the roof tile 10 in the uninstalled position from a similar viewpoint to that shown in FIG. 2. FIG. 4B schematically shows the same viewpoint as FIG. 4A, but illustrates the roof tile 10 in the installed position with the fastener 18 biasing or driving the body 20 against the mounting surface 16.

Comparing FIG. 4A with FIG. 4B, the fastener 18 is driven through the body 20—at the fastener points 32—to place the roof tile 10 into the installed position. The body 20 is biased against the mounting surface 16 by the fastener 18 to substantially close the first offset 46. Furthermore, although not viewable in FIG. 4B, the second offset 48 is also closed in the installed position.

Therefore, the body 20 abuts the mounting surface 16 and the underside 50 of the body 20 is substantially planar, as opposed to the dual arches of the uninstalled position. The roof tile 10 must be sufficiently flexible to allow the fastener 18 to bias the body 20 without fracturing any portions thereof. However, the roof tile 10 may be sufficiently rigid to retain some resistance to force applied to the body 20 and feel more like actual slate tile.

The uninstalled position may actually be further divided into an as-molded shape and a sagging shape. Generally, FIGS. 1-3 illustrated the roof tile 10 in the as-molded shape. The molds (not shown) used to form the roof tile 10 define both longitudinal and transverse arches into the body 20.

For example, the as-molded shape of the roof tile 10 may include arches defining the first offset 46 of up to approximately 0.375 inches and the second offset 48 of up to approximately 0.125 inches. The longitudinal length may be approximately 16 inches and the transverse width may be approximately 12 inches. Therefore, with the maximum respective offsets suggested above, the ratio (offset distance to span distance) of the longitudinal arch would be approximately 43 and the ratio of the transverse arch would be up to approximately 96.

However, when the roof tile 10 is removed from the mold, the weight of the body 20 may cause sagging by varying amounts, depending on: the materials used to form the roof tile 10, the size of the first offset 46 and the second offset 48, the longitudinal and transverse spans of the body 20, and any deformation resulting from storage or transport of manufactured roof tiles 10. The sagging shape may also be referred to as a resting shape or relaxed shape.

In the sagging position, for example, the body 20 may deflect enough to substantially close the second offset 48, such that the transverse arch may not be viewable when the roof tile 10 is resting on the mounting surface 16 or a planar surface. However, the lack of arch is a result of deformation away from the arch defining the second offset 48 in the as-molded shape.

In the installed position, the fastener 18 is reacted by the body 20 at, or around, the fastener points 32. However, the reaction forces between the mounting surface 16 and the body 20 are substantially at the corners of the body 20, as illustrated by reaction arrows 52.

Therefore, the roof tile 10 having the as-molded dual arches is pressing its corners against the mounting surface 16. Contrarily, a tile that is molded completely flat would be pressing against the mounting surface 16 at or around the fasteners 18. This may allow the corners of such a flat tile to curl away from the mounting surface slightly.

As illustrated in FIG. 4B, wind shear (illustrated by arrow 54) may provide an upward force on the roof tile 10, such as at the forward edge 22. The upward force of wind creates a moment between the front edge 22 and the fastener 18. However, the roof tile 10 counteracts this moment as a result of biasing the body 20 to close the first offset 46. Contrarily, a flat tile would not have any counteract moment, and the front edge thereof may lift away from the mounting surface 16 in heavy winds.

Figure 5:
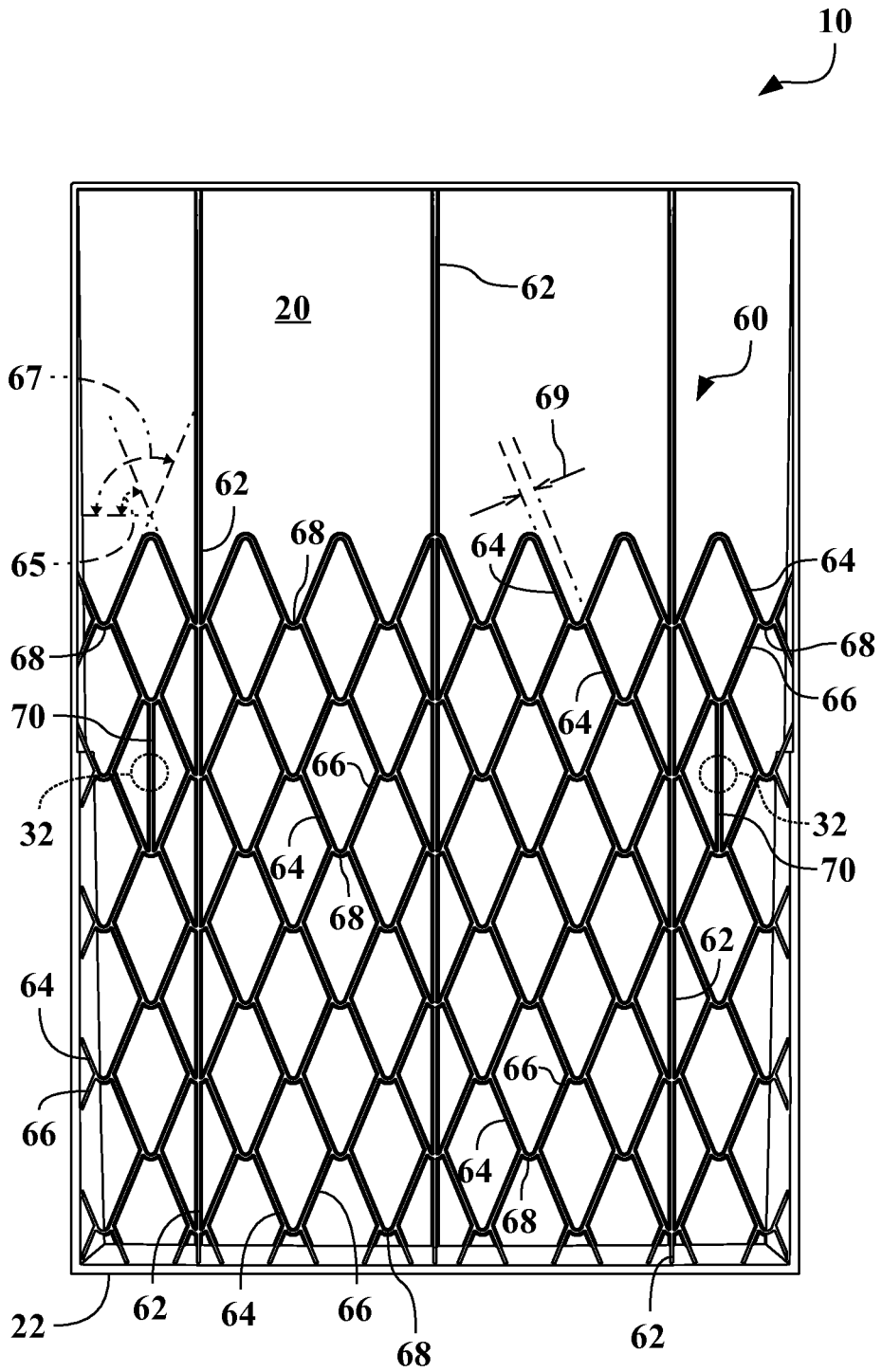
FIG. 5 is a schematic bottom view of the roof tile, illustrating a rib structure having elongated, filleted diamonds.

Referring now to FIG. 5, and with continued reference to FIGS. 1-4B, there is shown a bottom or underside view of the roof tile 10. The non-linear edge 28 is viewable in FIG. 5. The non-linear edge 28 imparts additional visual texture to the roof tile 10 and further emulates natural slate tiles.

In some configurations of the roof tile 10, the body 20 may include a plurality of ribs 60, as best viewed in FIGS. 5 and 5B. The ribs 60 may reduce the overall weight of the roof tile 10, relative to a solid body, while maintaining engineered structural characteristics. The ribs 60 may define a portion of the underside 50, such that moving the roof tile 10 from the installed to the uninstalled position includes closing the gap between the ribs 60 and the mounting surface 16.

The roof tile 10 may include at least one longitudinal rib 62, or cutting rib. The configuration shown in FIGS. 5 and 5B includes three longitudinal ribs 62—one located substantially at the center and two further toward the edges of the roof tile 10. The longitudinal ribs 62 allow the roof tile 10 to be cut vertically during installation and then installed to the mounting surface 16 without showing any of the gaps between the body 20 and the mounting surface 16. For example, when offsetting the second course of roof tiles 10, the installer may cut the first roof tile 10 in the second course in half by removing material to the left (as viewed in FIG. 5) of the central longitudinal rib 62. However, without the longitudinal rib 62, caverns or gaps may be visible from the edge of the mounting surface 16 (i.e., from the side of the roof).

The other two longitudinal ribs 62 (nearer the left and right edges) may also assist in installation by providing cut lines for the last roof tile 10 in the course. The longitudinal ribs 62 create both beginning and ending cut lines that allow the roof tiles 10 to be offset, and to be installed on different width roofs, without exposing visible gaps at the ends of the mounting surface 16. Note that the longitudinal ribs 62 are flush with the mounting surface 16 when the roof tile 10 is in the installed position. Additionally, the longitudinal ribs 62 extend from the front edge 22 toward the rear edge 24, and extend vertically at least as far as any of the other ribs 60.

The roof tile 10 includes a plurality of first-angle ribs 64, which are angled relative to the y-axis 12 and to the x-axis 14, and also relative to the forward edge 22, as illustrated by a first offset angle 65. The roof tile 10 also includes a plurality of second-angle ribs 66, which are angled relative to the first-angle ribs 64, the y-axis 12, and the x-axis 14, as illustrated by a second offset angle 67. In the orientation of FIG. 5, the first-angle ribs 64 are generally angled from the upper left toward the lower right, and the second-angle ribs 66 generally angled from the upper right toward the lower left.

The first-angle ribs 64 and the second-angle ribs 66 cooperate to form or define an elongated diamond pattern. However, unlike some diamond patterns, the intersections of which form a continuous and repeating "X," the first-angle ribs 64 and the second-angle ribs 66 do not have shared vertices. As used herein, a shared vertex refers to a single point at which two or more ribs intersect. For example, in the typical X-pattern, four ribs intersect at a shared vertex.

Furthermore, in the roof tile 10 shown, neither the first-angle ribs 64 nor the second-angle ribs 66 align with each other to form continuous lines. Adjacent first-angle ribs 64 are not collinear, such that there is an offset 69 between adjacent first-angle ribs 64. Similarly, adjacent second-angle ribs 66 are not collinear and have an offset (unnumbered) there between. Therefore, there is a space of several elongated diamonds before any of the first-angle ribs 64 or the second-angle ribs 66 align.

The first-angle ribs 64 and the second-angle ribs 66 also join to form a plurality of filleted or radial intersections 68. These radial intersections are arced or curved transitions between the first-angle ribs 64 and the second-angle ribs 66, as opposed to abrupt points or sharp transitions. In the orientation shown in FIGS. 5A and 5B, the radial intersections 68 are at the bottom of the elongated diamonds (with the exception of the uppermost diamonds). The radial intersections 68 prevent points at the vertices or intersections of the first-angle ribs 64 and the second-angle ribs 66. Points or sharp intersections may provide tear initiation or tear propagation cites for the roof tiles 10.

As illustrated in the figures, the ribs 60 substantially contact the mounting surface 16 when the roof tiles 10 are installed to the mounting surface 16, although some slight offsets may exist. Therefore, there are substantially no continuous channels or passageways through which gases or liquids could flow upward or downward between the body 20 and the mounting surface 16. The elongated diamond pattern formed by the first-angle ribs 64 and the second-angle ribs 66 breaks up all such pathways.

The ribs 60 shown provide improved strength characteristics in resisting wind loads. Furthermore, the ribs 60 may exhibit improved response to hail, or other storm impacts. As viewed in FIG. 5, the underside of the body 20 may also include a reinforcement rib 70 adjacent one or more of the fastener points 32. The reinforcement rib 70 may help prevent the fastener 18 from being over-driven, fracturing the roof tile 10, or both.

Figure 6:
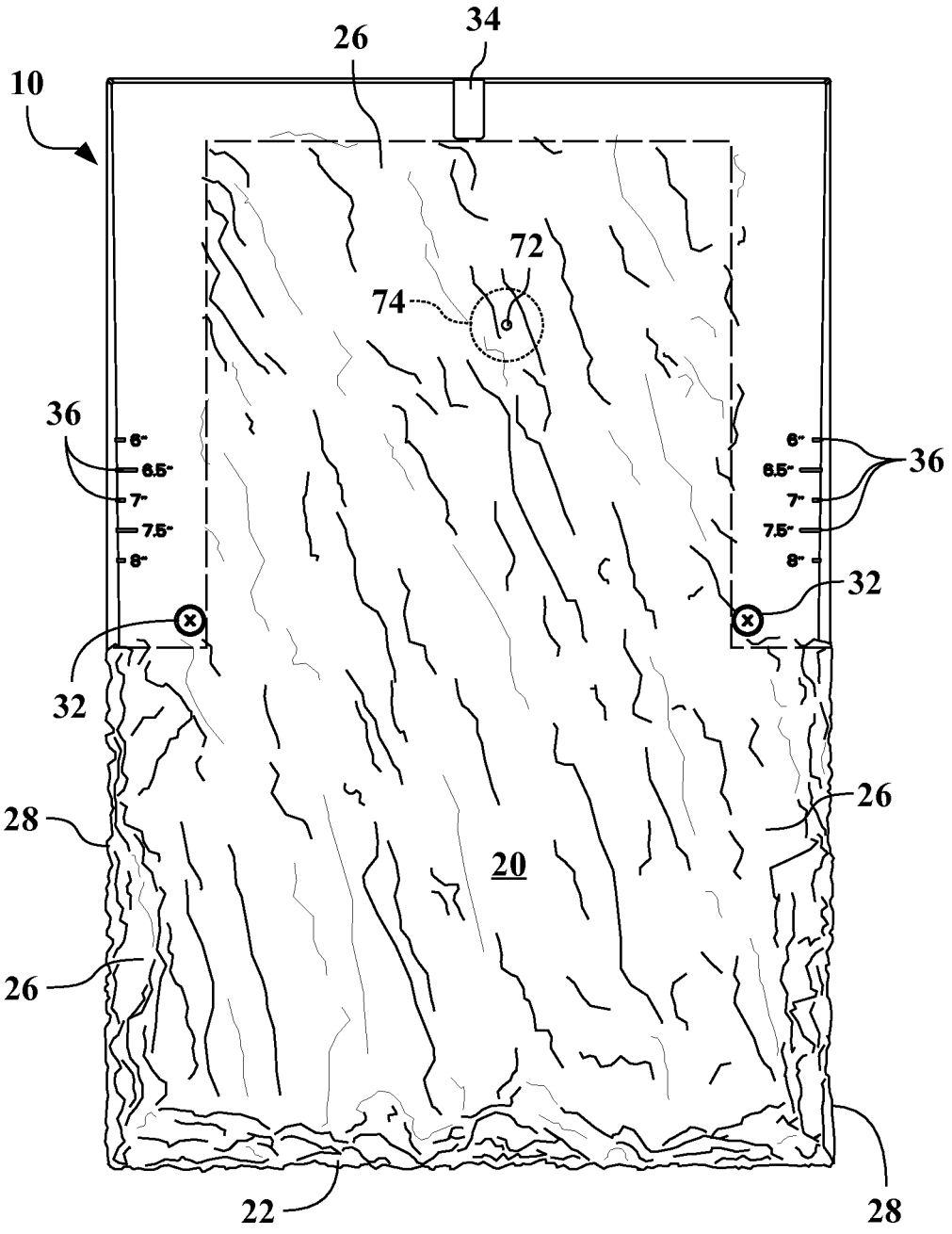
FIG. 6 is a schematic top view of the roof tile illustrating texture simulating natural slate.

Referring now to FIG. 6, and with continued reference to FIGS. 1-5B, there is shown a top or face view of the roof tile 10. The roof tile 10 shown is formed from injection molding as a single, continuous, and unitary component. There are no seams or portions of the roof tile 10 where two separately made components are later joined or fastened. Other molding or manufacturing processes may be used to form the roof tile 10.

FIG. 6 further illustrates the textured surface 26 and the non-linear edges 28 of the roof tile 10. The approximate border or edge of the textured surface 26 is shown in dashed lines. Note that the textured surface extends substantially to the left and right edges of the roof tile 10, such that no smooth surface should be visible in the keyways formed between installed roof tiles 10. In the configuration shown, the textured surface 26 extends to within at least one inch of the left and right sides or edges of the roof tile 10, and also to within at least one inch of the rearward edge 24.

The injection molding process occurs in a mold as polymeric or composite materials are injected into the mold at an offset injection point 72. In the configuration shown, a sprue injects the materials perpendicularly into what will become the face side 25 of the roof tile 10. As illustrated in FIG. 6, the offset injection point 72 is above the fastener points 32, such that it is also above the overlap line for the subsequent course of roof tiles 10.

Furthermore, the offset injection point 72 is also offset to either the left or the right (as viewed in FIG. 6) of the center mark 34 and the center line of the roof tile 10. Therefore, the offset injection point 72 will not be visible once subsequent courses of roof tiles 10 are installed, as the keyway formed between subsequent roof tiles 10 will not expose the offset injection point 72 to view, which may be aesthetically displeasing.

The roof tile 10 also includes an injection area 74 surrounding the offset injection point 72. The injection area 74 is textured, as opposed to smooth. This may be accomplished via post-injection processes, such as abrasion. Alternatively, the roof tile 10 may be formed in a mold with a textured injection nozzle, such that the texture is imparted during the injection molding process.

If the injection area 74 were smooth, portions of a non-textured area may be viewable through the keyways formed by subsequent courses of tiles, particularly if the injection point 72 is not sufficiently offset from the center of the roof tile 10. Furthermore, the textured injection area 74 shown may improve the in-hand aesthetics—before the roof tiles 10 are actually installed to the mounting surface—of the roof tiles 10 by minimizing a visible remnant of the manufacturing process.

The detailed description and the drawings or figures are supportive and descriptive of the structures and methods disclosed herein. While some of the best modes and other embodiments for carrying out the claimed structures and methods have been described in detail, various alternative designs, configurations, and embodiments exist for practicing the appended claims.

The invention claimed is:

1. A tile for attachment to a mounting surface, comprising:

a body defining a longitudinal length and a transverse width in a single, continuous component, and having a forward thickness at a forward edge and a rearward thickness at a rearward edge, wherein the forward thickness is greater than or equal to the rearward thickness, and including:

a plurality of first-angle ribs at a first offset angle relative to the forward edge;

a plurality of second-angle ribs at a second offset angle relative to the forward edge, wherein the second offset angle is different from the first offset angle and the first-angle ribs and the second-angle ribs join to form a plurality of radial intersections, wherein the body is movable between an uninstalled position and an installed position, such that:

in the uninstalled position, the body defines a first offset along the longitudinal length between the body and the mounting surface, and a second offset along the transverse width between the body and the mounting surface; and in the installed position, the body is biased against the mounting surface by a fastener to substantially close the first offset and the second offset, such that the body abuts the mounting surface and an underside of the body is substantially planar, and wherein the first offset along the longitudinal length is greater than the second offset along the transverse width.

2. The tile of claim 1, wherein the first-angle ribs and the second-angle ribs cooperate to substantially define a plurality of elongated diamonds, and wherein the first-angle ribs and the second-angle ribs substantially contact the mounting surface in the installed position.

3. The tile of claim 2, further comprising:

at least one longitudinal rib extending from the forward edge toward a rearward edge, wherein the longitudinal rib substantially contacts the mounting surface when the tile is installed to the mounting surface.

4. The tile of claim 3, wherein the longitudinal rib extends substantially to the rearward edge of the tile.

5. The tile of claim 4, wherein the first-angle ribs and second-angle ribs extend substantially to a left edge of the body and substantially to a right edge of the body.

6. The tile of claim 2, further comprising:

an offset injection point, wherein the offset injection point is not on a centerline of the body.

* * * * *